US007086564B1

(12) United States Patent
Corrigan

(10) Patent No.: US 7,086,564 B1
(45) Date of Patent: Aug. 8, 2006

(54) DISPENSER WITH AUDIBLE DOSE SIGNAL

(75) Inventor: Maurice Corrigan, Bernadsville, NJ (US)

(73) Assignee: Coty Inc., New York, NY (US)

( * ) Notice: Subject to any disclaimer, the term of this patent is extended or adjusted under 35 U.S.C. 154(b) by 0 days.

(21) Appl. No.: 10/308,908

(22) Filed: Dec. 3, 2002

(51) Int. Cl.
*A45D 40/06* (2006.01)

(52) U.S. Cl. ..... 222/39; 222/390; 401/171; 401/175

(58) Field of Classification Search ..... 222/39, 222/390; 401/194, 68, 72–75, 174, 175
See application file for complete search history.

(56) References Cited

U.S. PATENT DOCUMENTS 1,950,324 A * 3/1934 Powers ..... 401/194
4,521,127 A * 6/1985 Tomburo et al. ..... 401/175
4,595,124 A * 6/1986 Duval et al. ..... 222/39
5,000,356 A 3/1991 Johnson et al. ..... 222/391
5,573,341 A * 11/1996 Iaia ..... 401/175
5,851,079 A * 12/1998 Horstman et al. ..... 401/174
6,039,483 A * 3/2000 Szekely ..... 401/175
6,129,471 A * 10/2000 Lang ..... 401/194

* cited by examiner

*Primary Examiner*—Kenneth Bomberg
(74) *Attorney, Agent, or Firm*—Schwegman, Lundberg, Woessner & Kluth, P.A.

(57) ABSTRACT

The present invention includes a dispensing device denoting dosage with an audible signal. The dispensing device comprising: a drive mechanism comprising a threaded shaft and a screw; an elevator movable upwards and downwards on the threaded shaft upon turning of the screw; a barrel at least partially enclosing the drive mechanism, the barrel defining a stovepipe, the stovepipe defining an inner surface, facing the screw of the drive mechanism; at least one indentation defined by the inner surface of the stovepipe; and at least one bump defined by the screw so that turning the screw moves the bump into and out of the indentation, creating an audible signal.

8 Claims, 5 Drawing Sheets

DISPENSER WITH AUDIBLE DOSE SIGNAL

The present invention relates to a device with an audible dose signal and to a method for making a device with an audible dose signal.

BACKGROUND OF THE INVENTION

Swivel-up dispensing devices have been a popular choice for dispensing antiperspirant materials. One type of dispensing device is described in U.S. Pat. No. 5,000,356 ('356). The '356 patent describes a dispensing package that uses a feed screw to drive an elevator which impels a cream product and dispenses the product in incremental doses. A drive of the feed screw is superimposed with reciprocatory motion caused by internal cams which retract the elevator. By intermittently retracting the elevator a particular distance, discrete amounts of the product are dispensed for each cycle and the residual pressure on the product is relieved, preventing it from weeping onto the application surface of the dispenser.

SUMMARY OF THE INVENTION

One embodiment of the present invention includes a dispensing device that signals dosage of a cosmetic material, with an audible signal. The dispensing device includes a drive mechanism comprising a threaded shaft and a rotating element. The dispensing device also includes an elevator movable upwards and downwards on the threaded shaft upon rotation of the drive mechanism. The dispensing device further includes a barrel at least partially enclosing the drive mechanism and cosmetic material being dispensed, the barrel defining a stovepipe, the stovepipe defining an inner surface, facing the rotating element of the drive mechanism. The dispensing device further includes at least one indentation defined by the inner surface of the stovepipe; and at least one bump defined by the drive mechanism so that rotating the rotating element and screw moves the bump into and out of the indentation, creating an audible signal.

Another embodiment of the present invention includes a dispensing device denoting dosage with an audible signal. The dispensing device includes a drive mechanism comprising a threaded shaft and a rotating element. The dispensing device also includes an elevator movable upwards and downwards on the threaded shaft upon rotating of the rotating element. The dispensing device further includes a barrel at least partially enclosing the drive mechanism. The barrel defines a stovepipe. The stovepipe defines an inner surface, facing the screw of the drive mechanism. The dispensing device also includes at least one bump defined by the inner surface of the stovepipe and at least one indent defined by the screw so that rotating the screw moves the bump into and out of the indentation, creating an audible signal.

DETAILED DESCRIPTION

Figure 1:
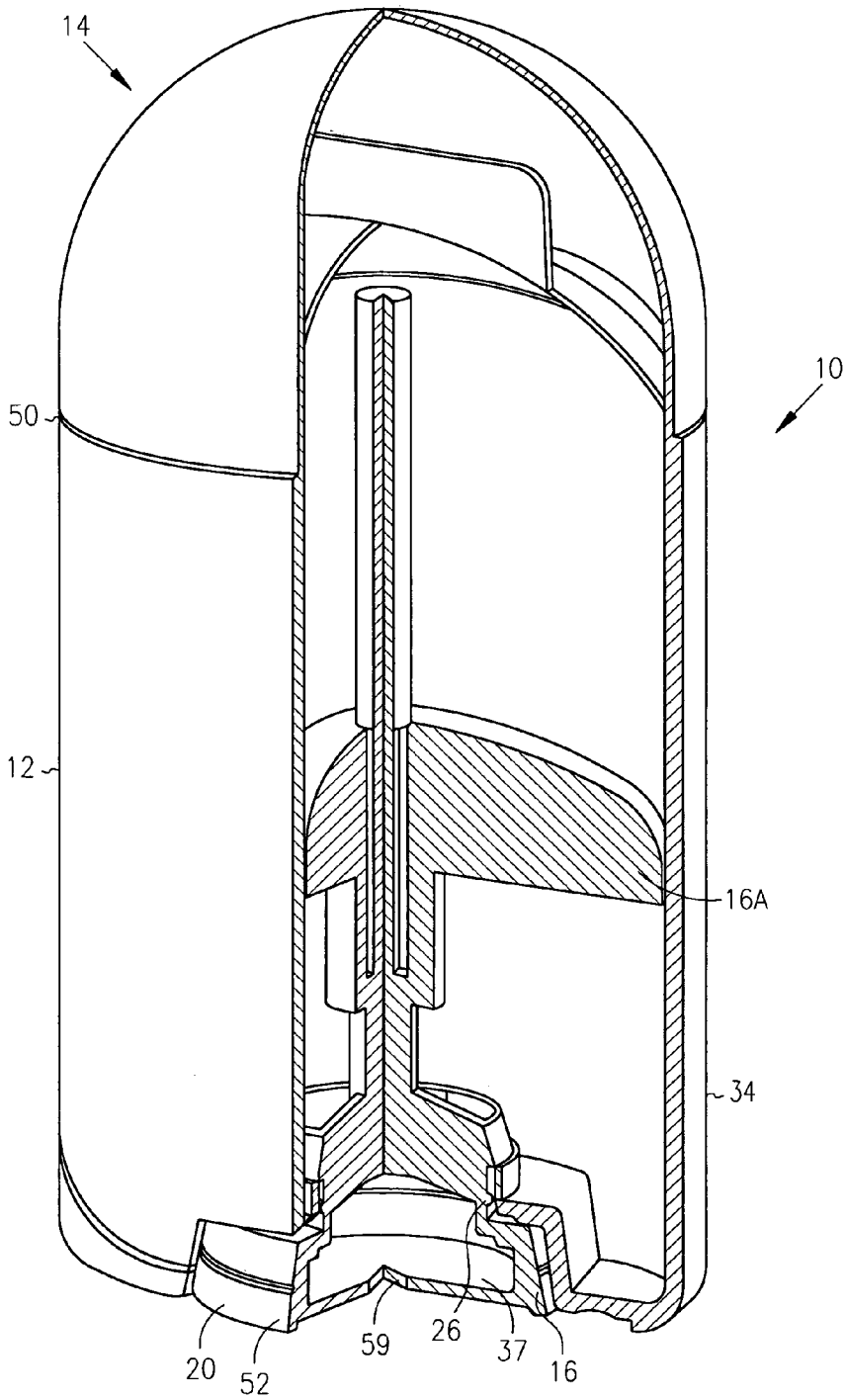
FIG. 1 is a perspective, cutaway view of dispensing device that produces an audible signal, of the present invention.
Figure 5:
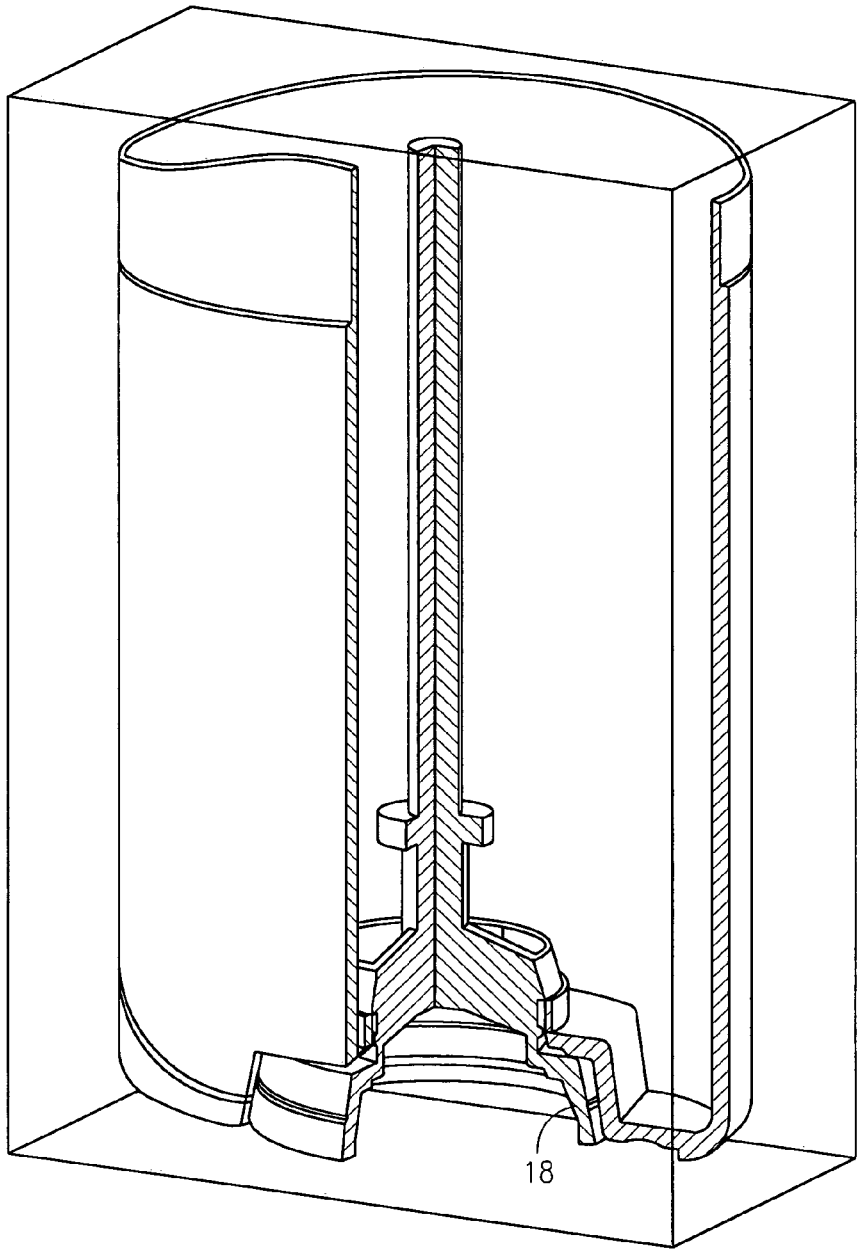
FIG. 5 is a perspective, cutaway view of the dispensing device, illustrating the audible click mechanism.
Figure 6:
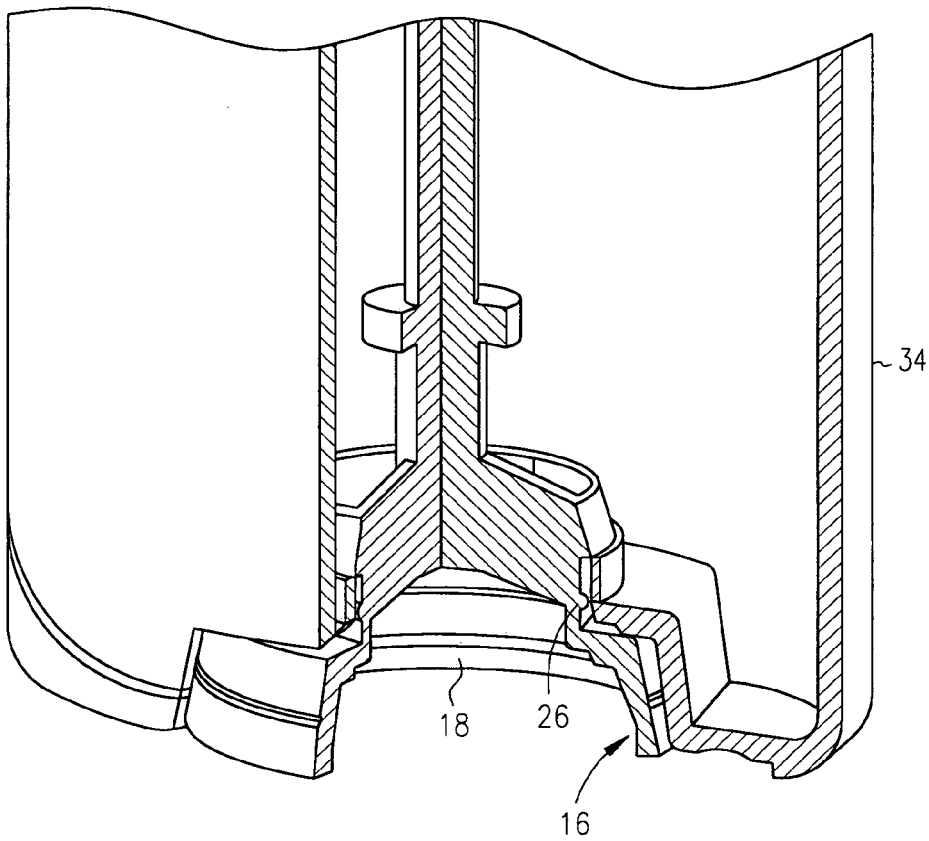
FIG. 6 is a perspective, cutaway view of the audible signal mechanism of the device of the present invention.

The dispenser of the present invention, one embodiment of which is illustrated generally at 10 in FIG. 1, includes a barrel 12, an overcap 14 that is attachable to the barrel 12, a drive mechanism 16 for driving deodorant or other material enclosed in the barrel 12 out of the barrel, and an audible signal mechanism 18, illustrated in FIGS. 5 and 6, that is at least partially enclosed within the barrel 12 and that is activated by the drive mechanism 16. The dispensing device of the present invention 10 is usable for dispensing antiperspirant and other cosmetic gels and creams. The dispensing device of the present invention 10 produces an audible signal denoting dosage or dosage fraction by employing an audible signal mechanism 18. The audible signal mechanism 18 does not require use of a cam-driven mechanism, that has traditionally been employed. The audible signal mechanism 18 is built into the barrel 12 and drive mechanism 16.

The barrel 12 of the dispensing device 10 is made from any material capable of holding a barrel shape and includes materials such as polymers, metals, composite materials and glass. In the embodiment shown in FIG. 1, the barrel 12 terminates in a lip 50. While a lip 50 is shown, other suitable attachment embodiments include one or more threads for retaining the overcap 14. An opposing end of the barrel 12 defines an inner stovepipe 34. Once the device 10 is assembled, the stovepipe 34 is adjacent to the drive mechanism 16.

The stovepipe 34 includes an outer, stepped surface 35 that faces the inner barrel wall under the antiperspirant containment and an inner surface 37 that faces the drive mechanism 16. The inner surface 37 includes one component embodiment of the audible signal mechanism 18, which is a plurality of indents, also known herein as splines, 24*a*, 24*b*, 24*c* and 24*d*, shown in FIG. 3 and a deep indent 24*e*, adjacent to splines 24*c* and 24*d*.

The drive mechanism 16 of the dispensing device 10 includes a smooth turning feed screw 20 and an elevator 22 wherein the feed screw 20 raises the elevator 22, as the feed screw 20 is turned in a first direction, which may be clock-wise or counter-clockwise. The elevator 22 includes an elevator cup 16*a* that is, in some embodiments, integral with the elevator. The elevator 22 is lowered by reversing direction of the feed screw 20 rotation. The feed screw 20 is rotated to raise the elevator 22, in order to dispense a stick product, which is not shown. The feed screw is rotated by turning knob 56. The knob 56 defines a bottom sealing plug 59 for sealing antiperspirant or other cosmetic product in the barrel 12. For some embodiments, the drive mechanism 16 is used to dispense a gel or creme type cosmetic product.

Figure 2:
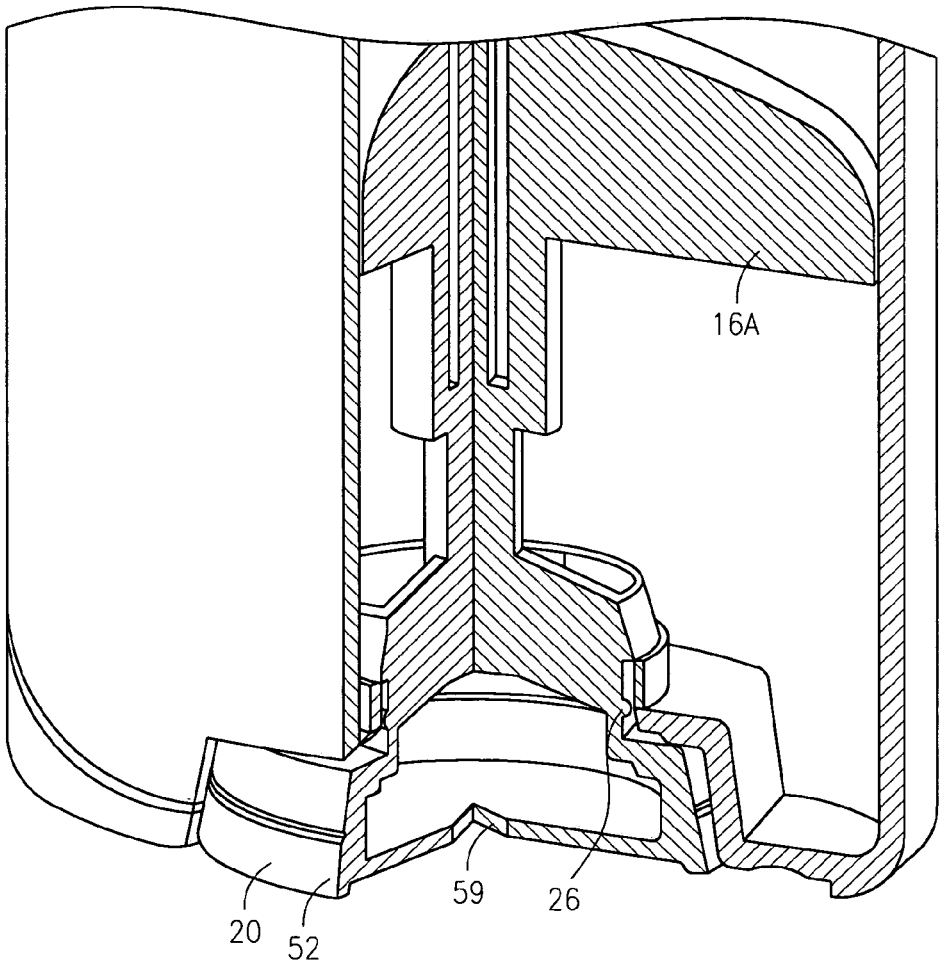
FIG. 2 is a cutaway perspective view of the dispensing device of the present invention, illustration the audible signal mechanism.

In one embodiment, the drive mechanism 16 includes a plurality of bumps, one of which is shown at 26 in FIG. 2, that act in concert with the splines 24*a*, 24*b*, 24*c* and 24*d* of the audible signal mechanism 18 to create an audible signal when a dosage or fraction of a dosage is dispensed.

Figure 3:
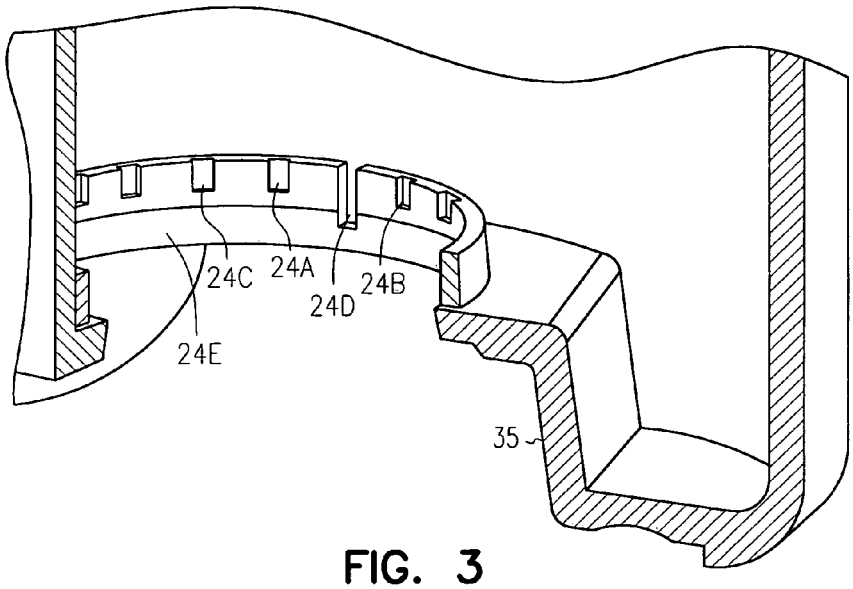
FIG. 3 is a perspective view of one embodiment of the audible signal mechanism of the present invention.
Figure 4:
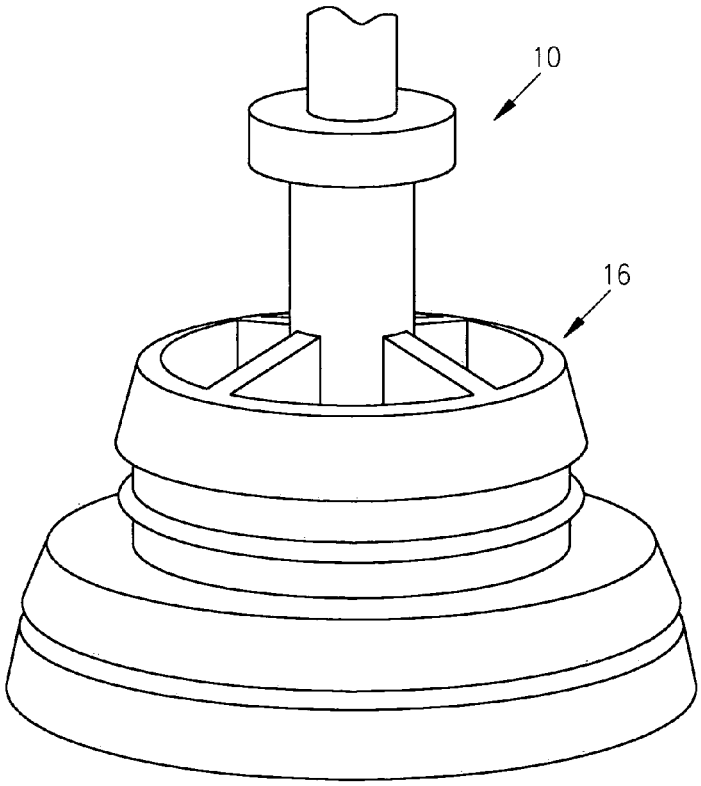
FIG. 4 is a perspective view of a drive mechanism of the dispensing device of the present invention.

In one embodiment, the audible signal mechanism 18 includes the plurality of splines 24*a*, 24*b*, 24*c*, and 24*d*, shown in FIG. 3, and one or more detente bumps, one of which is shown at 26 in FIG. 6, that are built into the stovepipe 34 and drive mechanism 16, respectively, of the dispensing device 10. In particular, the drive mechanism includes an upper surface 58, illustrated in FIG. 6, that contacts the inner surface of the stovepipe 34 that defines splines 24*a*, 24*b*, 24*c* and 24*d*. Movement of the feed screw 20, radially moves the one or more detente bumps 26. As the bumps 26 contact and move over the splines 24*a*, 24*b*, 24*c*, and 24*d*, positioned on the stovepipe 34, the contact produces an audible noise. The bumps 26 or splines 24*a*, 24*b*, 24*c* and 24*d* are positionable so that one audible sound is produced for a dosage. With this embodiment, rotation of the feed screw produces an audible "click" signal when the four bumps pass over four corresponding splines.

In another embodiment, one of the splines, 24*e*, is larger and, optionally, deeper than the splines 24*a* to 24*d*. The bumps are positioned equidistant from each other and relative to the rotation of the feed screw to denote dosage. The audible signal in this embodiment includes a series a small, "clicks" and another click, producing a different audible sound, denoting that one rotation has been completed. While four bumps are described, it is understood that more bumps 26 and fewer bumps are usable in embodiments of the device of the present invention.

In one other embodiment, which is not shown, the audible signal mechanism includes one bump 26 and one spline 24. An audible signal is produced when the bump 26 moves over the spline 24 as the drive mechanism 16 is rotated. In another embodiment, an audible noise is produced only when the bump 26 contacts the spline 24*e*.

In another embodiment, the audible noise produced by the device of the present invention denotes a fraction of a dosage. For instance, one embodiment of the audible signal mechanism 18 includes two splines on the stovepipe and one bump on the drive mechanism 16. The splines are positioned equidistant from each other. The bump produces an audible signal denoting that a fraction of a dosage is dispensed as the bump passes over each of the splines.

While embodiments have been described with the splines 24 positioned on the stovepipe and the bumps 26 on the drive mechanism 16, it is understood that other configurations are possible. In another embodiment, the splines are built into the drive and the bumps are built into the barrel.

The dispensing device of the present invention is capable of dispensing either a solid stick product or a gel or cream type product through a dispensing screen. Components included in the mechanism that provides the audible click, such as the spline and detent components, are built into the barrel and the screw.

In one embodiment, the dispensing device is packaged in a box or other type of enclosure. The package is used for both solid sticks and the gel/cream antiperspirants. The common barrel 12 is fitted with a separate embodiment of the drive mechanism for a gel-type product.

When the solid stick feed screw is snapped into the stovepipe and turned, it drives the product elevator with a smooth-turning motion. As there are no detent ribs 42 present, there is no interference from the barrel splines. Thus, a common barrel serves to produce two different effects: a smooth-running dispensing of a solid stick product and, with the use of a detent screw, an audible sound useful in determining the quantity of a gel or cream product that is being dispensed. The package of the present invention may be made by standard methods known in the art such as injection molding. Materials from which the package and its component parts may be formed include polyethylene, polypropylene, polyethylene terphthalate and other polyesters as well as other polymeric materials such as polystyrene, polystyrene copolymers, polyvinylchloride and polyvinylchloride copolymers and combinations and mixtures thereof.

The assembled container when filled with a solid stick material such as a deodorant is used by simply removing the slide-on cap and turning the thumbscrew to elevate a desired portion of the solid stick material. In the case where a cream or gel formulation is used, a cap or dispensing screen through which the material is extruded covers the top inner portion of the container. By rotating the exposed thumbscrew 40, the material is dispensed and a clicking sound is heard to indicate the quantity of material being dispensed to the user.

Although specific embodiments have been illustrated and described herein, it is appreciated by those of ordinary skill in the art that any arrangement which is calculated to achieve the same purpose may be substituted for the specific embodiment shown. This application is intended to cover any adaptions or variations of the present invention. Therefore, it is manifestly intended that this invention be limited only by the claims and the equivalents thereof.

What is claimed is:

1. A dispensing device denoting dosage with an audible signal, comprising:

A drive mechanism comprising a threaded shaft and a screw;

An elevator movable upwards and downwards on the threaded shaft upon turning of the screw;

A barrel at least partially enclosing the drive mechanism, the barrel defining a stovepipe, the stovepipe defining an inner surface that includes a plurality of indents wherein the plurality includes at least one indent that is larger than the other indents of the plurality, facing the screw of the drive mechanism;

At least one indentation defined by the inner surface of the stovepipe; and

At least one bump defined by the screw so that turning the screw moves the bump into and out of the indentation, creating an audible signal.

2. The dispensing device of claim 1 wherein the screw defines a plurality of bumps.

3. The dispensing device of claim 2 wherein the plurality of bumps are positioned equidistant from each other.

4. The dispensing device of claim 1 wherein the barrel and stovepipe with at least one indent are a single unitary article.

5. A dispensing device denoting dosage with an audible signal, comprising:

a drive mechanism comprising a threaded shaft and a screw;

an elevator movable upwards and downwards on the threaded shaft upon turning of the screw;

a barrel at least partially enclosing the drive mechanism, the barrel defining a stovepipe, the stovepipe defining an inner surface that includes a plurality of indents wherein the plurality includes at least one indent that is larger than the other indents of the plurality, facing the screw of the drive mechanism;

at least one bump defined by the inner surface of the stovepipe; and at least one indent defined by the screw so that turning the screw moves the bump into and out of the indentation, creating an audible signal.

6. The dispensing device of claim 5 wherein the screw defines a plurality of bumps.

7. The dispensing device of claim 6 wherein the plurality of bumps are positioned equidistant from each other.

8. The dispensing device of claim 5 wherein the barrel and stovepipe with at least one indent are a single unitary article.

* * * * *

UNITED STATES PATENT AND TRADEMARK OFFICE

CERTIFICATE OF CORRECTION

PATENT NO. : 7,086,564 B1
APPLICATION NO. : 10/308908
DATED : August 8, 2006
INVENTOR(S) : Corrigan It is certified that error appears in the above-identified patent and that said Letters Patent is hereby corrected as shown below:

In column 4, line 21, in Claim 1, delete “A” and insert -- a --, therefor.

In column 4, line 23, in Claim 1, delete “An” and insert -- an --, therefor.

In column 4, line 25, in Claim 1, delete “A” and insert -- a --, therefor.

In column 4, line 31, in Claim 1, delete “At” and insert -- at --, therefor.

In column 4, line 33, in Claim 1, delete “At” and insert -- at --, therefor.

Signed and Sealed this

Thirteenth Day of February, 2007

JON W. DUDAS
*Director of the United States Patent and Trademark Office*